US007481078B2

(12) United States Patent
Okamoto

(10) Patent No.: US 7,481,078 B2
(45) Date of Patent: Jan. 27, 2009

(54) KNITWEAR KNITTED BY FLAT KNITTING MACHINE AND METHOD FOR KNITTING THE SAME

(75) Inventor: Kazuyoshi Okamoto, Wakayama (JP)

(73) Assignee: Shima Seiki Manufacturing, Ltd., Wakayama (JP)

( * ) Notice: Subject to any disclaimer, the term of this patent is extended or adjusted under 35 U.S.C. 154(b) by 63 days.

(21) Appl. No.: 11/720,349

(22) PCT Filed: Nov. 24, 2005

(86) PCT No.: PCT/JP2005/021534

§ 371 (c)(1),
(2), (4) Date: May 29, 2007

(87) PCT Pub. No.: WO2006/057277

PCT Pub. Date: Jun. 1, 2006

(65) Prior Publication Data

US 2008/0209953 A1 Sep. 4, 2008

(30) Foreign Application Priority Data

Nov. 29, 2004 (JP) ..... 2004-345007

(51) Int. Cl.
*D04B 7/10* (2006.01)

(52) U.S. Cl. ..... 66/70; 66/176

(58) Field of Classification Search ..... 66/68, 66/69, 70, 75.1, 170, 171, 172 R, 169 R, 66/175, 169 A See application file for complete search history.

(56) References Cited

U.S. PATENT DOCUMENTS

| | | | | |
|---|---|---|---|---|
| 5,826,445 | A | 10/1998 | Okamoto | |
| 5,987,930 | A | 11/1999 | Nakai | |
| 6,286,340 | B1 | 9/2001 | Yui | |
| 6,397,639 | B2 | 6/2002 | Haltenhof et al. | |
| 6,581,417 | B2 * | 6/2003 | Yui | 66/176 |
| 6,658,899 | B2 * | 12/2003 | Okamoto | 66/64 |
| 6,658,900 | B2 * | 12/2003 | Okamoto | 66/64 |
| 6,796,149 | B2 | 9/2004 | Okamoto et al. | |
| 6,889,530 | B2 * | 5/2005 | Urano et al. | 66/64 |
| 7,212,881 | B2 * | 5/2007 | Kazuyoshi | 700/141 |
| 7,222,504 | B2 * | 5/2007 | Nakayama | 66/64 |

* cited by examiner

*Primary Examiner*—Danny Worrell
(74) *Attorney, Agent, or Firm*—Rothwell, Figg, Ernst & Manbeck, P.C.

(57) ABSTRACT

An improved knitting method for joining together a front body part and a back body part of knitwear at the shoulder parts. In the knitting method in which groups of stitches comprising a plurality of wales of the body located at a widthwise lateral end portion thereof on the side on which a course is formed are moved toward a center of the body by loop transfer and by racking, to form double stitches, the groups of stitches at the lateral end portion comprise at least four wales, the at least four wales being separated into three or more inside wales and at least one outside wale, and the narrowing process is performed by moving the inside wales one stitch and moving the outside wale two stitches.

4 Claims, 8 Drawing Sheets

KNITWEAR KNITTED BY FLAT KNITTING MACHINE AND METHOD FOR KNITTING THE SAME

CROSS REFERENCE TO RELATED APPLICATION

This application is a 35 USC § 371 National Phase Entry Application from PCT/JP2005/021534, filed Nov. 24, 2005, and designating the United States.

TECHNICAL FIELD

The present invention relates to an improved knitting method for joining together a front body and a back body of knitwear such as a sweater and a vest at a shoulder part thereof by using a flat knitting machine, and knitwear knitted by the same method.

BACKGROUND ART

A variety of knitting methods called a seamless knitting technique have been invented for knitwear knitted by using a flat knitting machine having at least a pair of front and back needle beds extending in a transverse direction, disposed opposite to each other in a cross direction, and being capable of being racked in the transverse direction so that loops can be transferred between the front and back needle beds. When the knitwear such as a sweater, for example, is knitted using the flat knitting machine described above, its body is knitted in the form of a tubular knitted fabric whose front body part and back body part are continuously joined at both ends thereof, starting at hem parts thereof toward shoulder parts thereof, while also its sleeves located at right and left sides of the body are also knitted in a tubular form, respectively, Then, the sleeves are joined to the body while being moved toward the body, and further the front body part and the back body part are joined together at the shoulder parts. This knitting method known as the seamless knitting technique can provide the result of eliminating or simplifying the post-process such as a sewing process after completion of the knitting.

This knitting technique is disclosed by Patent Document 1 and Patent Document 2, for example. FIG. 9 is a view showing a right half of a sweater 20 knitted by the method described by those Patent Documents, when viewed from the back body part side. FIG. 10-A shows a stitch structure of the back body part in an area of a joining line 23 of the shoulder part, and FIG. 10-B shows a view showing the knitting steps schematically. Shaded portions of FIG. 10-A indicate groups of stitches in the wale at the lateral end portion, and framed portions of the same figure indicate double stitches. Arrows in FIG. 10-B indicate loop transfer in which stitches of the front body are transferred to be overlapped with stitches of the back body. In FIG. 10-B, the groups of stitches in the wale at the lateral end portion are indicated by black circles, and the stitches held after the knitting for the narrowing stitch are depicted at the upper side. The Patent Documents cited above describes that the knitwear is made in the following processes. The body and the sleeves are respectively knitted in a tubular form, starting at hem parts thereof, and are united with each other at armhole parts thereof. Thereafter, every time that a proper number of courses are knitted, the sleeves are overlapped with the body to be joined to each other. This knitting proceeds up to the shoulder parts. When the knitting comes at the shoulder parts, the knitting of the front body part is stopped and the joining of the front body part and the back body part starts from the shoulder tip to the collar part sequentially while the shoulder part of the back body part is knitted in a trapezoid form. By knitting the shoulder part in the trapezoid form, a silhouette slanting downwardly from the collar part toward the shoulder tip is formed. The shoulder part is knitted by a so-called inside narrowing process that every time that the back body part is knitted by a predetermined number of courses, the stitches of the front body part at the lateral end portion thereof are overlapped with the stitches of the back body part at the lateral end portion thereof to be joined thereto, while at the same time, groups of front stitches comprising a predetermined number of wales of the back body part at the lateral end portion thereof are displaced so that the back body can be narrowed in knitting width. As a result of this, a fashion line 25 extending in parallel with the joining line is formed by the groups of stitches of the wales of the back body part at the lateral end portion.

Patent Document 1: Japanese Unexamined Patent Publication No. Hei 09-273051

Patent Document 2: International Publication No. WO00-12799

DISCLOSURE OF THE INVENTION

Problem to be Solved by the Invention

As described in the Patent Documents cited above, since the wales formed along the joining line by the inside narrowing process are formed from the front stitches and knitted by plain knitting, the lateral end portion of the back body part is in general liable to curl toward the front body part due to the nature of the knitted fabric. Due to this, the wales formed by the inside narrowing process are protruded at the periphery of the joining line, thus exerting an undesirable influence on the silhouette of the knitwear when worn in some instances. In the light of the disadvantage mentioned above, the present invention has been made. It is an object of the present invention to provide an improved knitting method for joining together a front body part and a back body part of knitwear such as, for example, a sweater and a vest at the shoulder part using the flat knitting machine. It is another object of the present invention to provide knitwear knitted by the same method.

Means for Solving the Problem

This invention is directed to a knitwear knitting method using a flat knitting machine having at least a pair of front and back needle beds extending in a transverse direction and disposed opposite to each other in a cross direction, at least either of which is capable of being racked in the transverse direction and between which stitches can be transferred, wherein with at least a front body part of a body of the knitwear assigned to a first needle bed and a back body part associated to a second needle bed, the body is knitted in the form of a tubular knitted fabric whose front body part and back body part are joined at both widthwise ends thereof, starting at hem parts thereof toward shoulder parts thereof, while also one of the front body part and the back body part is joined to the other body part at the shoulder part while at least one of them being knitted, and further the body is narrowed in knitting width at the shoulder part by a narrowing process that groups of stitches comprising a plurality of wales of the body at a widthwise lateral end portion thereof on the side on which a course is formed are moved toward a center of the body by loop transfer and by racking, to form double stitches, and wherein the groups of stitches at the lateral end portion comprise at least four wales, which are separated into three or more inside wales and at least one outside wale, and the narrowing process is performed by moving the inside wales one stitch and moving the outside wale two stitches.

Preferably, the groups of stitches at the lateral end portion are formed by six to eighteen wales and the outside wale is formed by one to five wales.

Further preferably, the outside wale is formed by a single wale.

Also, this invention is directed to knitwear knitted by using a flat knitting machine having at least a pair of front and back needle beds extending in a transverse direction and disposed opposite to each other in a cross direction, at least either of which is capable of being racked in the transverse direction and between which stitches can be transferred, wherein its body is knitted in the form of a tubular knitted fabric whose front body part and back body part are joined at both widthwise ends thereof, starting at hem parts thereof toward shoulder parts thereof, while also one of the front body part and the back body part is joined to the other body part at the shoulder part while at least one of them being knitted, and further the body is narrowed in knitting width at the shoulder part by a narrowing process that groups of stitches comprising a plurality of wales of the body at a widthwise lateral end portion thereof on the side on which a course is formed are moved toward a center of the body to form double stitches, and wherein the groups of stitches at the lateral end portion comprise at least three wales comprising two or more inside wales and at least one outside wale, and the narrowing process is performed by moving the inside wales one stitch and moving the outside wale two stitches.

Effect of the Invention

In the knitting method of this invention, the knitwear is knitted from its hem part toward its shoulder part, and the front body part and the back body part are joined together at the shoulder part while at least one of them is knitted and also gradually narrowed in knitting width from the shoulder tip portion to the collar portion so that the sewing process after the knitting process can be eliminated or simplified. In the joining process for joining together the front body part and the back body part at the shoulder part, when groups of stitches of the body at a widthwise lateral end portion thereof on the side on which a course is formed are moved toward a center of the body by loop transfer and by racking, the groups of stitches at the lateral end portion are formed by three or more inside wales and at least one outside wale, and the inside wales are moved one stitch for the narrowing and the outside wale is moved two stitches for the narrowing. This narrowing process can produce the result that a first double stitch is formed at a boundary between a main body part of the body and the inside wales of the groups of stitches at the lateral end portion and a second double stitch is formed at a boundary between the inside wales of the groups of stitches at the lateral end portion and the outside wale. Since the inside wales are formed by three or more wales, the first double stitch and the second double stitch are spaced apart from each other through other stitches. When this narrowing process is performed repeatedly, the wales of the groups of stitches at the lateral end portion are not extended in parallel with the joining line in the shoulder line and are formed at an angle with a vertical direction, differently from the conventional narrowing process. In other words, by the narrowing process repeatedly performed together with the knitting of courses, the stitches of the inside wales at the lateral end portion are also gradually displaced to a lateral side of the knitted fabric and are eventually overlapped with the joining line so as to be eventually invisible. As a result of this, the front stitches are not formed in parallel with the joining line, as in the conventional process, and accordingly the related parts can be prevented from curling and protruding.

EXPLANATION OF LETTERS OR NUMERALS

| | | |
|---|---|---|
| 1: Sweater | 2f: Front body part | 3f: Front sleeve part |
| 2b, 21: Back body part | 3b: Back sleeve part | 5: Hem part |
| 7: Shoulder part | 9, 23: Joining line | 2fr: Right front body part |
| 2fl: Left front part | 11: Groups of stitches at lateral end portion | |
| 11a: Inside wale | 11b: Outside wale | 13: First double stitch |
| 15: Second double stitch | 17, 25: Fashion line | |

BEST MODE FOR CARRYING OUT THE INVENTION

In the following, best modes for carrying out the invention will be described with reference to the accompanying drawings.

Embodiments

Figure 1:
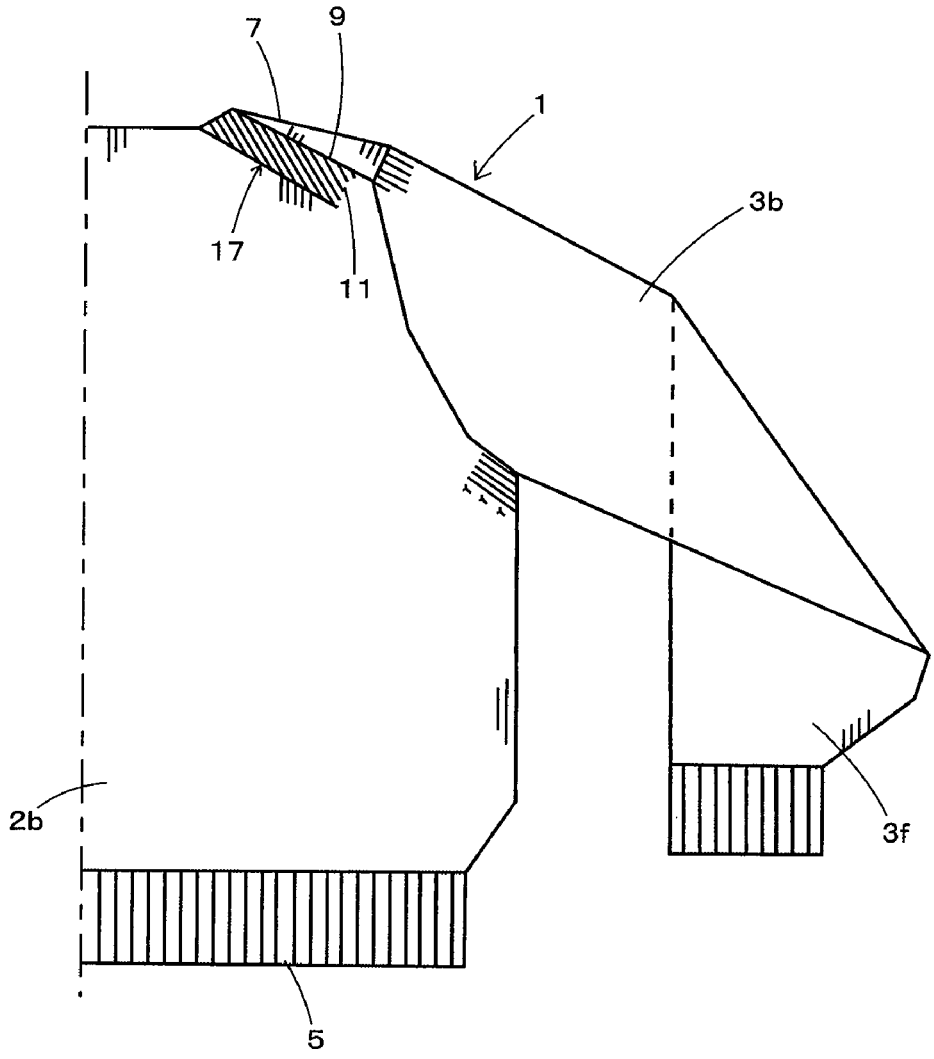
FIG. 1 is an illustration of a sweater knitted by a knitting method of an embodiment of the invention when viewed from the back body side.

Certain embodiments of the present invention will be described with reference to FIGS. 1 to 6. FIG. 1 is an illustration of a right half of a sweater 20 with set-in sleeves knitted by a knitting method of an embodiment of the invention when viewed from the back body side. In the embodiments, a four-bed flat knitting machine comprising a pair of front and back needle beds extending in a transverse direction and disposed opposite to each other in a cross direction, and another pair of needle beds arranged over those pair of needle beds is used for knitting the sweater 1. The flat knitting machine in which only the back needle beds are capable of being racked in the transverse direction to allow transfer of stitches between the front needle beds and the back needle beds is used herein, but another type of flat knitting machine in which both the front needle beds and the back needle beds are capable of being racked may alternatively be used. For example a computer-aided flat knitting machine available from Shima Seiki Mfg., Ltd. (Product name: SWG-X) may be used as this type of flat knitting machine. When the knitwear is knitted in a tubular form by the four-bed type flat knitting machine, front knitted fabric parts of the tubular knitted fabrics are assigned to the lower front needle bed. Then, front stitches of the front knitted fabric parts of the sleeves and the body, for example, are knitted with needles of the lower front needle bed, and back stitches of the same are knitted with needles of the upper back needle bed. Also, front stitches of the back knitted fabric parts are knitted with needles of the lower back needle bed, and back stitches of the same are knitted with needles of the upper front needle bed. For convenience of explanation, the sweater with no pattern is cited as an example of the knitwear in the embodiments, but the sweater may have a designed structure pattern such as, for example, a wide rib, a moved pattern, and a cable pattern. Also, samples of the knitwear include other knitwear such as a vest and a cardigan.

Figure 2:
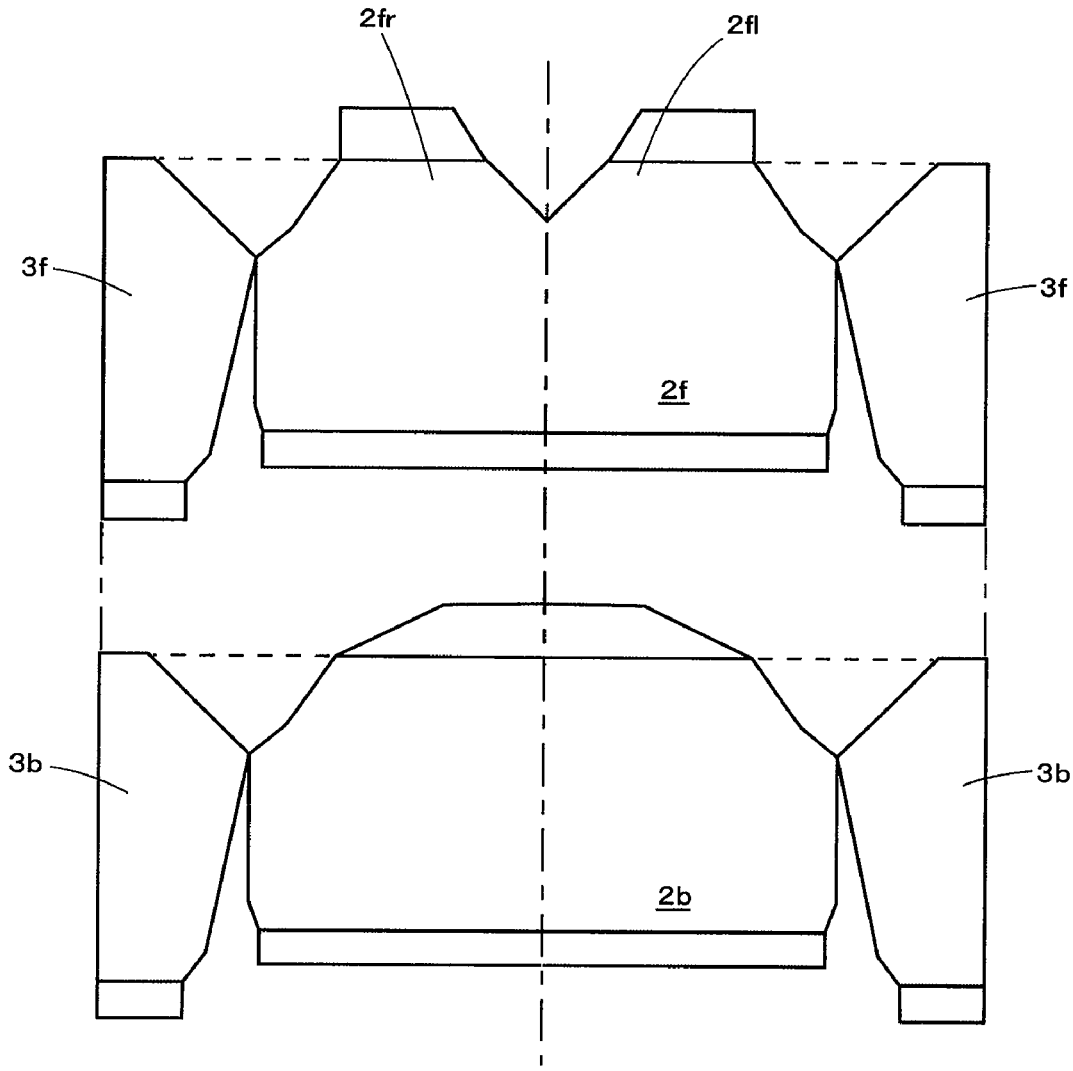
FIG. 2 is a view showing a pattern paper of the sweater.
Figure 3:
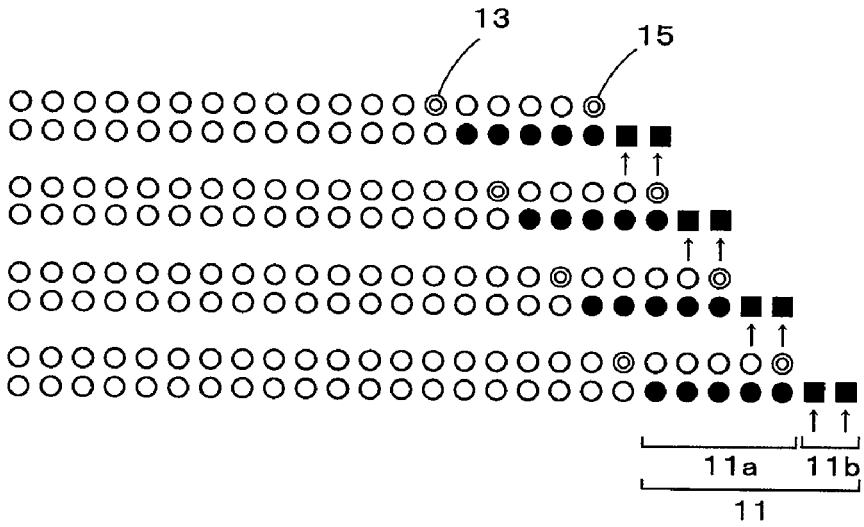
FIG. 3 shows in FIG. 3-A a view of a stitch structure in an area of a joining line and shows in FIG. 3-B a view showing the knitting steps schematically.
Figure 3:
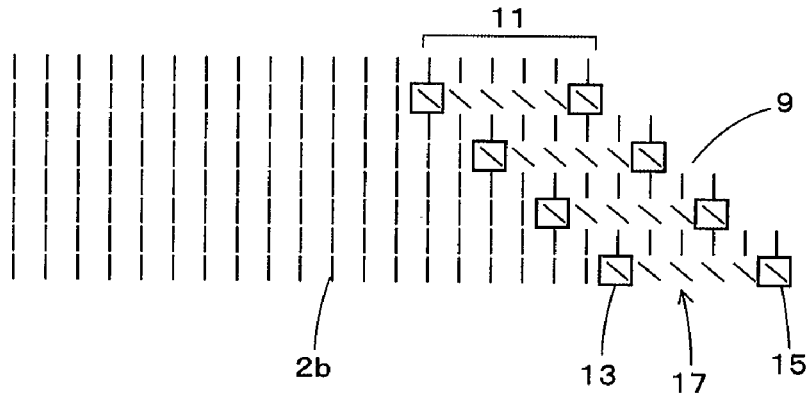
Figure 10:
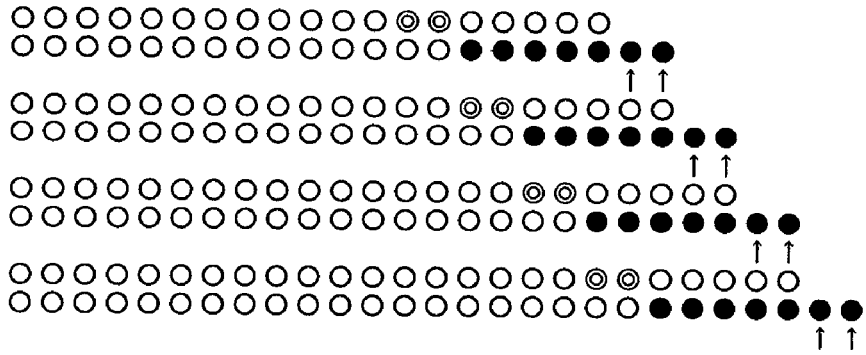
FIG. 10 shows in FIG. 10-A a stitch structure in an area of a joining line knitted by the conventional knitting method and shows in FIG. 10-B the knitting steps schematically.
Figure 10:
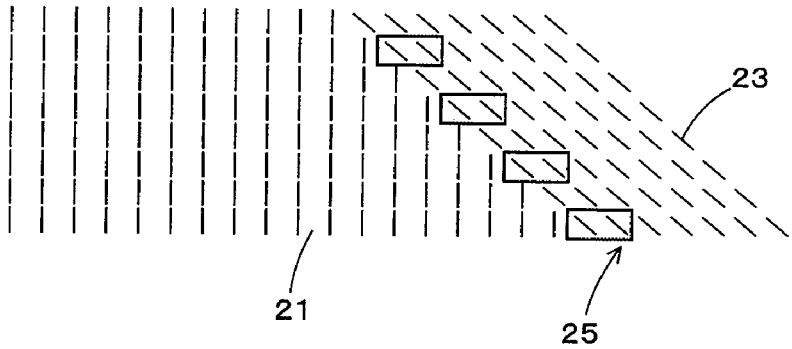

FIG. 2 shows a pattern paper of the sweater 1. The front knitted fabric part (a front body part 2*f*, a front sleeve part 3*f*) is shown at an upper side of the figure, and the back knitted fabric part (a back body part 2*b*, a back sleeve part 3*b*) is shown at a lower side of the same. The sweater 1 is knitted in the manner that the body and the sleeves are respectively knitted in a tubular form, first, starting at hem parts thereof, using a yarn feeder (not shown), and are united with each other at armhole parts thereof. Thereafter, every time that a proper number of courses are knitted, the sleeves are overlapped with the body to be joined to each other. This knitting proceeds up to the shoulder parts 7. FIG. 3 is a corresponding view to FIG. 10. FIG. 3-A shows a stitch structure in an area of a joining line 9 schematically, and FIG. 3-B shows the knitting steps schematically. In FIG. 3-B, inside wales 11*a* of groups of stitches located at the lateral end portion 11 mentioned later are indicated by black circles and outside wales 11*b* are indicated by black boxes, and the stitches which are in the state of being held after having been narrowed are shown at an upper side thereof.

Figure 4:
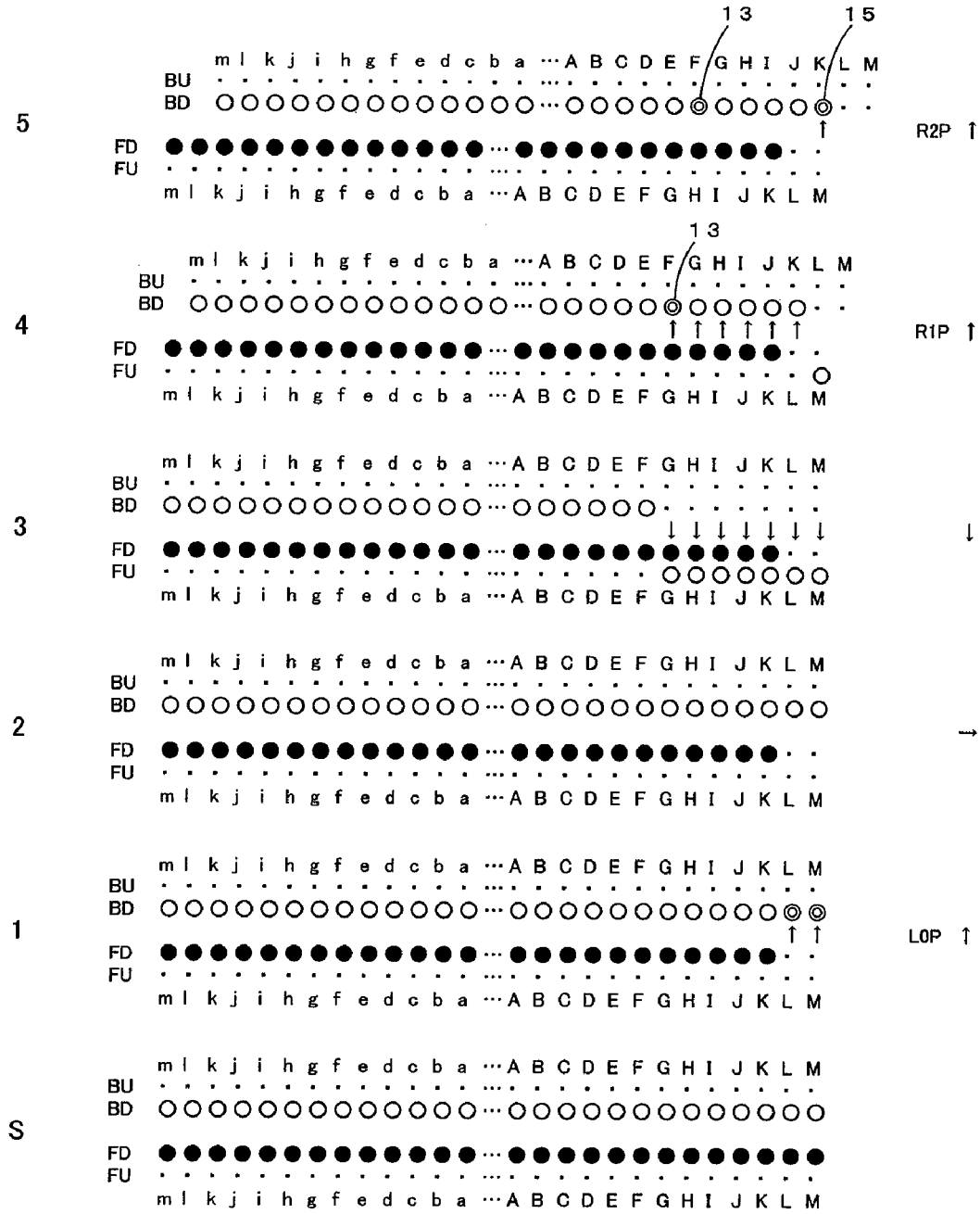
FIG. 4 is a view showing the knitting steps for the joining at the shoulder part in detail.
Figure 5:
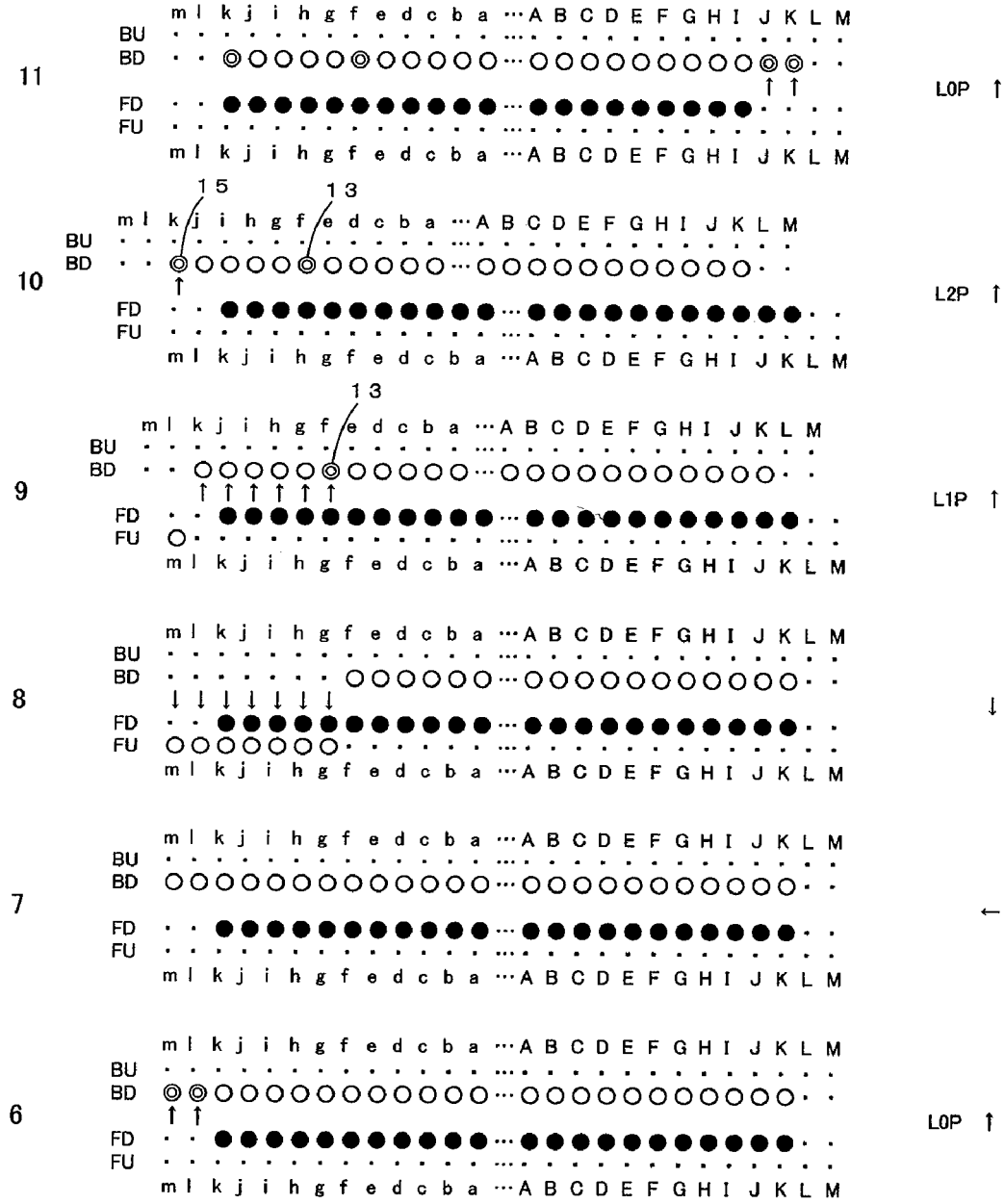
FIG. 5 is a view showing the knitting steps for the joining at the shoulder part sequent to those of FIG. 4.

In the following, the knitting steps for joining together the front body part 2*f* and the back body part 2*b* at the shoulder parts are described in detail with reference to FIGS. 4 and 5. In these figures, FD denotes a lower front needle bed, FU an upper front needle bed, BD a lower back needle bed, and BU an upper back needle bed. Stitches of the front body part 2*f* are represented by black circles, and the stitches of the back body part 2*b* are represented by outline circles. Also, double stitches are represented by double circles. Horizontal arrows represent a traveling direction of a yarn feeder, and vertical arrows represent a direction for a stitch to be moved by loop transfer. Marks such as L2P, for example, indicate racking pitches (distances) of the back needle beds. For convenience of explanation, a fewer number of needles used for the knitting than the actual number of needles used for the knitting is illustrated. Only the stitches of the right and left sleeves are shown and the stitches of the collar part located therebetween are omitted. In FIG. 4, the step S shows the state of the stitches being held on the needle beds just before the knitting for joining together the front body part 2*f* and the back body part 2*b* at the shoulder parts is about to start. In the step S, the stitches of a right sleeve portion of the front body part 2*f* are held on the needles m-a of the lower front needle bed, and the stitches of a left shoulder portion of the front body part 2*f* are held on the needles M-A. Also, the stitches of the back body part 2*b* are held on the needles m-M of the lower back needle bed. It is to be noted that the terms used herein to describe the right side and the left side of the respective parts, such as, for example, the right front body part 2*fr* and the left front body part 2*fl*, mean that they are on the right side and on the left side when viewed from a person putting on the sweater 1.

In the step 1, the stitches at the lateral end portion of the front body part, which are held on the needles L and M of the lower front needle bed located at the shoulder tip portion of the left front body part 2*fl*, are transferred to the needles L and M of the lower back needle bed to be overlapped with the stitches at the lateral end portion of the shoulder part of the back body part 2*b*. Then, in the step 2, the yarn feeder is moved rightwards to feed the yarn therefrom to the needles m-M of the lower back needle bed so as to form stitch courses of the shoulder part of the back body part 2*b*. In the sequent step 3, in order to form a new fashion line formed along a joining line 9 of the back body part 2*b*, groups of stitches at the lateral end portion comprising a plurality of wales at the widthwise lateral end, or in the embodiment, the groups of stitches comprising seven wales at the lateral end portion held on the needles G-M of the lower back needle bed, are taken as the groups of stitches 11 at the lateral end portion and transferred to the needles of the upper front needle bed. The groups of stitches 11 at the lateral end portion comprising seven wales are formed by six inside wales 11*a* located inwardly and one outside wale 11*b* located laterally. In FIG. 3-B, the inside wales 11*a* are represented by black circles, and the outside wales 11*b* are represented by black boxes. In the step 4, the back needle bed is racked rightwards one pitch from an original point and then the stitches of the inside wales held on the needles G-L of the groups of stitches at the lateral end portion held on the needles G-M of the upper front needle bed are transferred to the needles F-K of the lower back needle bed. As a result of this, a double stitch (a first double stitch 13) is formed on the needle F. This double stitch 13 is formed at a boundary between a main body portion of the body part and the inside wales of the groups of stitches at the lateral end portion.

In the next step 5, the back needle bed is further racked rightwards one pitch and then the stitch of the outside wale 11*b* held on the needle M of the upper front needle bed is transferred to the needle K of the lower back needle bed to form another double stitch (a second double stitch 15) thereon. This double stitch 15 is formed at a boundary between the inside wales 11*a* and the outside wale 11*b*. The first double stitch 13 is formed by moving the stitches of the inside wales one stitch, and the second double stitch 15 is formed by moving the stitch of the outside wale two stitches. Through the steps 1-5 described above, the front body part and the back body part are respectively narrowed in width two stitches at the left shoulder parts thereof. The double stitches formed by these steps are spaced apart from each other, one being formed on the inner side of the knitted fabric and the other being formed on the outer side of the knitted fabric.

Figure 6:
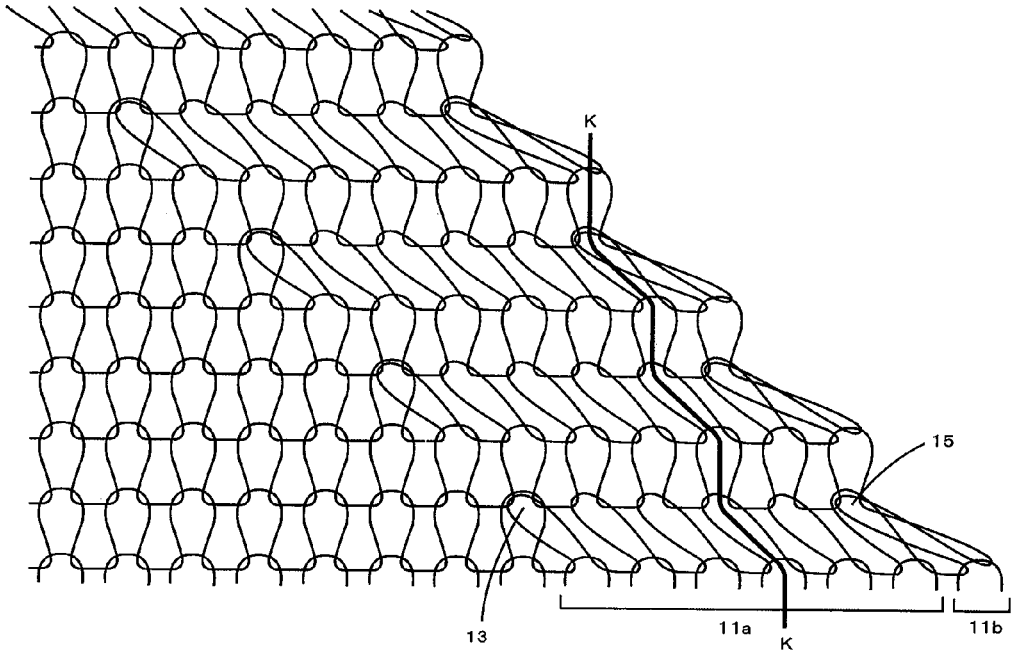
FIG. 6 is a view showing in detail the stitch structure at the shoulder part of the back body part.

The sequent steps 6-10 show the knitting of the right shoulder part of the body, corresponding to the steps 1 to 5 described above, respectively. The racking direction of the needle beds in these steps is leftwards which is opposite to the racking direction in the former steps. Through the knitting in these steps, the front body part and the back body part are respectively narrowed in width two stitches at the right shoulder parts thereof. The next step 11 shows the knitting corresponding to the step 1. By taking the steps 1-10 repeatedly for the knitted fabric of the remaining shoulder part, the stitches of the shoulder parts of the front and back bodies are sequentially released from the needles between the shoulder tip portion and the collar part, with which the knitting for joining together the shoulder parts is ended. As a result of this, a new fashion line 17 is formed to be parallel with the joining line 9 in the shoulder part. The wales of the groups of stitches 11 at the lateral end portion are not extended in parallel with the joining line 9 but are formed at an angle with a vertical direction. FIG. 6 shows in detail the stitch structure of the shoulder part of the back body part. By the narrowing process repeatedly performed, the stitches of the respective wales of the groups of stitches 11 at the lateral end portion are gradually displaced inwardly and are eventually overlapped with the joining line 9 so as to be invisible. This can be seen from for example the wale K in the groups of stitches 11 at the lateral end portion in FIG. 6. As a result of this knitting, the front stitches are not formed in parallel with the joining line, as in the conventional process, and accordingly the related parts can be flattened. It is to be noted that the stitches of the front body part are omitted from FIG. 6.

Although the embodiment wherein the groups of stitches 11 at the lateral end portion are formed by seven wales, and six of the seven wales are taken as the inside wales 11*a* and one wale is taken as the outside wale 11*b* has been described above, as long as the groups of stitches 11 at the lateral end portion are formed by at least four wales and at least three of the four wales are taken as the inside wales and at least one of the four wales are taken as the outside wale, the same operation and effect can be provided, because such can provide the result that the first double stitch 13 and the second double stitch 15 can be spaced apart from each other. The groups of stitches may be properly determined depending on the gauge for the knitted fabric knitted. For example, the groups of stitches may be formed by six to eighteen wales and one to five wales may be taken as the outside wale. Also, the first double stitch 13 and the second double stitch 15 need not necessarily be within the same course, as in the embodiment described above. For example, in the case where the knitting for joining together the body parts at the shoulder parts is performed every time that two stitch courses are formed, all the wales of the groups of stitches at the lateral end portion may be moved in the first course to form the first double stitch 13 and the outside wale may be moved further one stitch in the next course to form the second double stitch 15. In this variant, the wales located between the first double stitch 13 and the second double stitch 15 serve as the inside wales and the wale located outside of the second double stitch 15 serve as the outside wale. This means that the outside wale was moved substantially two stitches.

Figure 7:
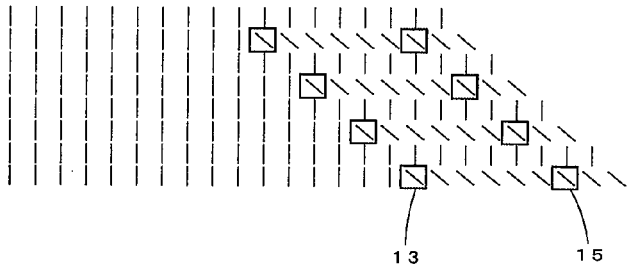
FIG. 7 is a view showing in detail a stitch structure in an area of a joining line of another embodiment.
Figure 8:
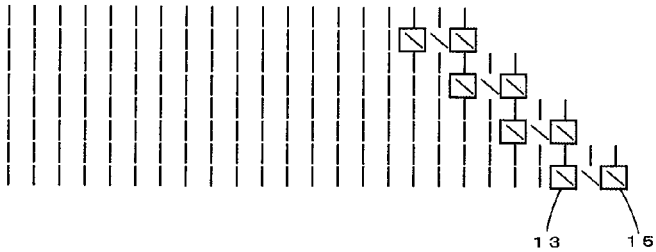
FIG. 8 is a view showing in detail a stitch structure in an area of a joining line of yet another embodiment.
Figure 9:
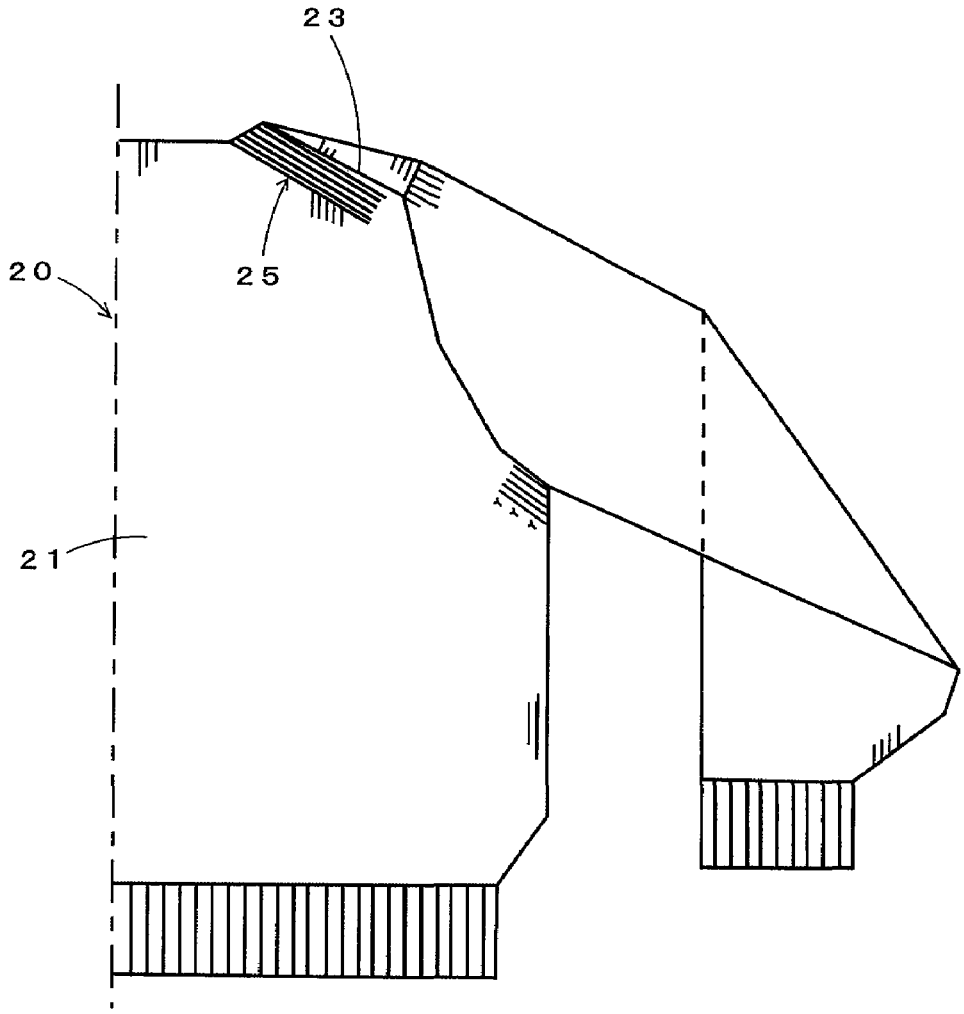
FIG. 9 is a view showing a sweater knitted by a conventional knitting method when viewed from the back body part side.

FIGS. 7 and 8 show views corresponding to FIG. 3-A. In FIG. 7, the groups of stitches 11 at the lateral end portion are formed by ten wales, and seven of the ten wales are taken as the inside wales and three of the ten wales are taken as the outside wale. FIG. 6 shows the embodiment wherein the groups of stitches 11 at the lateral end portion are formed by four wales, and three of the four wales are taken as the inside wales and one of the four wales is taken as the outside wale.

Although the embodiment of the knitting method using the four-bed flat knitting machine has been described above, the knitting method of the invention may be used for a variant using the two-bed flat knitting machine. In this variant, the knitwear is knitted with every other needles of each of the front and back needle beds. For example, the front knitted fabric parts to be knitted in the tubular form are knitted with odd needles and the back knitted fabric parts of the same are knitted with even needles. This can provide the result that the empty needles can always be kept on the opposite needle beds. By using these empty needles, the knitted fabric having knitting patterns of mixed front-and-back stitches, such as links, purl stitch, and ribs, can be knitted in a tubular form and can be transferred to the opposite needle bed. Although the embodiment wherein while being knitted, the back body part is joined to the front body part which stopped knitting has been described above, the relationship between the both may of course be reversed for the knitting of the knitwear. Alternatively, the knitting described above may be applied for the front and back body parts while being knitted concurrently.

The invention claimed is:

1. A knitwear knitting method using a flat knitting machine having at least a pair of front and back needle beds extending in a transverse direction and disposed opposite to each other in a cross direction, at least either of which is capable of being racked in the transverse direction and between which stitches can be transferred, wherein with at least a front body part of a body of the knitwear assigned to a first needle bed and a back body part associated to a second needle bed, the body is knitted in the form of a tubular knitted fabric whose front body part and back body part are joined at both widthwise ends thereof, starting at hem parts thereof toward shoulder parts thereof, while also one of the front body part and the back body part is joined to the other body part at the shoulder part while at least one of them being knitted, and further the body is narrowed in knitting width at the shoulder part by a narrowing process that groups of stitches comprising a plurality of wales of the body at a widthwise lateral end portion thereof on the side on which a course is formed are moved toward a center of the body by loop transfer and by racking, to form double stitches, and wherein the groups of stitches at the lateral end portion comprise at least four wales, which are separated into three or more inside wales and at least one outside wale, and the narrowing process is performed by moving the inside wales one stitch and moving the outside wale two stitches.

2. The knitwear knitting method according to claim 1, wherein the groups of stitches at the lateral end portion are formed by six to eighteen wales and the outside wale is formed by one to five wales.

3. The knitwear knitting method according to claim 2, wherein the outside wale is formed by a single wale.

4. Knitwear knitted by using a flat knitting machine having at least a pair of front and back needle beds extending in a transverse direction and disposed opposite to each other in a cross direction, at least either of which is capable of being racked in the transverse direction and between which stitches can be transferred, wherein its body is knitted in the form of a tubular knitted fabric whose front body part and back body part are joined at both widthwise ends thereof, starting at hem parts thereof toward shoulder parts thereof, while also one of the front body part and the back body part is joined to the other body part at the shoulder part while at least one of them being knitted, and further the body is narrowed in knitting width at the shoulder part by a narrowing process that groups of stitches comprising a plurality of wales of the body at a widthwise lateral end portion thereof on the side on which a course is formed are moved toward a center of the body to form double stitches, and wherein the groups of stitches at the lateral end portion comprise at least three wales comprising at least two inside wales and at least one outside wale, and the narrowing process is performed by moving the inside wales one stitch and moving the outside wale two stitches.

* * * * *